United States Patent [19]

Gould

[11] 4,110,872

[45] Sep. 5, 1978

[54] MOULDED PLASTIC CLIP DEVICE

[75] Inventor: Peter Brian Gould, Normanhurst, Australia

[73] Assignee: Advance Industries Limited, New South Wales, Australia

[21] Appl. No.: 802,951

[22] Filed: Jun. 2, 1977

[51] Int. Cl.[2] ..... B42F 1/00

[52] U.S. Cl. ..... 24/67.11

[58] Field of Search ..... 24/67 R, 67.3, 67.5, 24/67.7, 67.9, 67.11, 243 R; 40/23 R, 23 A

[56] References Cited

U.S. PATENT DOCUMENTS

| | | | |
|---|---|---|---|
| 3,404,435 | 10/1968 | Freundlich | 24/67.9 |
| 3,756,550 | 9/1973 | Kollitz | 24/67.5 |
| 3,968,546 | 7/1976 | Seaborn et al. | 24/67.11 |

FOREIGN PATENT DOCUMENTS

| | | | |
|---|---|---|---|
| 1,460,035 | 10/1966 | France | 24/67.7 |

*Primary Examiner*—Henry S. Jaudon

[57] ABSTRACT

A clip device made up of two separable members, each member having on it a jaw portion, the members being pivotable relative to each other, one of the said members having on it a length of acetal or other suitable plastic material supported only by its ends and adapted to form a torsion bar, the other member being attached to the first in such a manner that the torsion bar portion is preloaded to bring the jaw portions into contact, one or both being provided with a portion to which finger pressure may be applied to separate the jaws against the torque of the torsion member.

2 Claims, 3 Drawing Figures

MOULDED PLASTIC CLIP DEVICE

The present invention relates to a moulded clip device formed entirely from plastic material.

A variety of clip devices are used for different purposes an example of one class of such device being a clip board fitting which is used for securing loose papers to a supporting sheet of plywood, fiberboard or like material, the clip consisting of a part that is fixed to the board and a movable part that is hinged to it, the two parts being interconnected by means of a spring which acts to urge portions of them constituting jaws into contact, the arrangement being such that pressure may be applied to the movable part to separate the jaws of the clip to enable papers to be inserted between them. Subsequent release of the movable part causes the paper to be gripped. Such clip devices are normally constructed from metal, using a metallic spring. The object of the present invention however is to provide a clip device which consists of only two parts and is moulded wholly from plastic material.

The present invention consists of a clip device made up of two separable members, each member having on it a jaw portion the members being pivotable relative to each other, one of the said members having on it a length of acetal or other suitable plastic material supported only by its ends and adapted to form a torsion bar, the other member being attached to the first in such a manner that the torsion bar portion is preloaded to bring the jaw portions into contact, one or both being provided with a portion to which finger pressure may be applied to separate the jaws against the torque of the torsion member. It is preferred that one of the members be adapted for attachment to a board or like object.

In order that the invention may be better understood and put into practice a preferred form thereof is hereinafter described by way of example with reference to the accompanying drawings in which.

Figures 1, 2, 3:
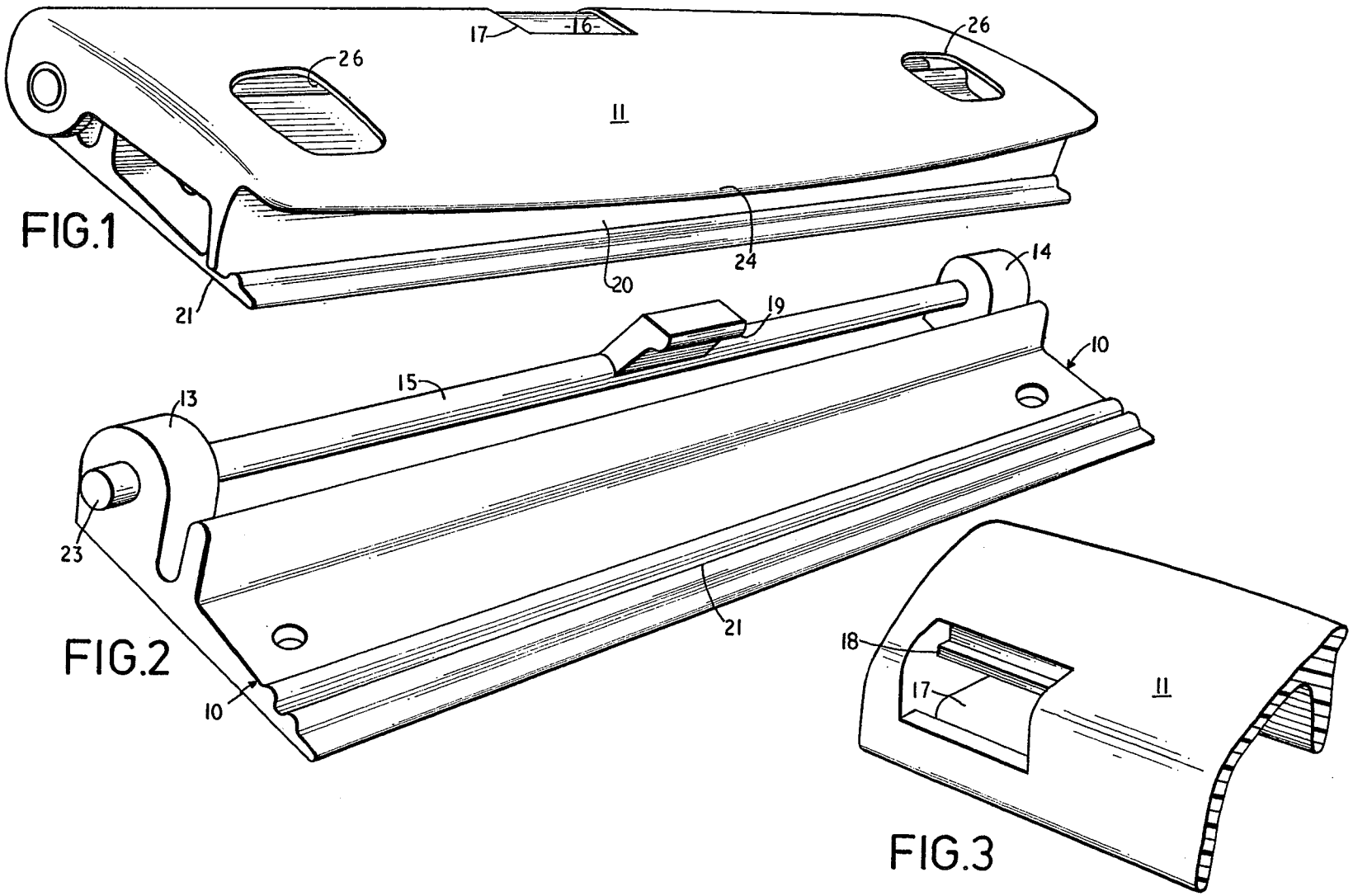
FIG. 1 shows a clip device according to the invention with the parts assembled.
FIG. 2 shows the fixed part of the device.
FIG. 3 shows to an enlarged scale a portion of the movable part of the device.

In the preferred form of the invention it is applied to provide a two piece moulded clip board fitting consisting of a base part 10 and a movable part 11. Each part is moulded from a plastic material the base part being preferably moulded from acetal plastic and the movable part from, for example, A.B.S. plastic.

The base 10 is formed with a flat underside to enable it to be placed on a piece of board constituting a clip board and attached to it by means of rivets passing through the holes 12. At opposite ends of the base are upstanding lugs 13-14 which between them support an integrally moulded torsion bar 15 having on it a central lug 16, shaped as shown.

The movable part 11 is shaped to overlie the base 10, it being provided with a central aperture 17 which overlies the lug 16 in such a manner that shoulder 18 may be engaged under the lip 19 of the lug 16. The dimensions of the relevant parts are such that when this is done the part 11 is pressed along its forward edge 20 against the forward edge 21 of the base, these two parts constituting the jaws of the clip. When the parts are assembled, it has the effect of pretensioning the torsion bar 15 through an angle of approximately 30° and results in the movable part 11 exerting a force of 0.35–1.0 Kg at the jaws.

The ear 32 of the part 11 overlies the lug 13, a hole in it fitting over one end of the projection 23 which together with a similar arrangement at the other end provides a hinged connection between the parts. If the lip 24 of the part 11 is raised by means of finger pressure, the parts are separated by pivotal movement until the torsion bar has been loaded through about a further 60°. If the lip 24 is released the cover 11 returns to its original position to grip any papers which may be inserted between the jaws. The movable part 11 is provided with holes 26 to give access to the fixing holes 12 in the base.

It will be seen that the invention provides a two piece clip board fitting each piece being moulded from plastic material, the pieces being capable of being assembled very quickly and simply to constitute a fitting which is extremely effective in use and free from corrosion.

While the invention has been described as applied to a moulded clip board fitting it will be appreciated that the principles of the invention may be applied equally well to any other types of clip device within the scope of the invention as defined broadly above.

I claim:

1. A clip device made up of two separable members, each member having on it a jaw portion, the members being pivotable relative to each other, one of the said members having on it a length of acetal or other suitable plastic material supported only by its ends and adapted to form a torsion bar, the other member being attached to the first in such a manner that the torsion bar portion is preloaded to bring the jaw portions into contact, one or both being provided with a portion to which finger pressure may be applied to separate the jaws against the torque of the torsion member.

2. A clip device as claimed in claim 1 wherein one of said members constitutes a fixed member and is adapted for attachment to a surface and has upstanding lugs between which said length of plastic material extends, the said length of plastic material having on it a lug extending radially from its axis, the said lug engaging a portion of the other member so that on pivoting the said other member relative to the fixed member to separate said jaw portions said plastic member is torsionally deformed.

* * * * *